US005340305A

United States Patent [19]

Joyce

[11] Patent Number: 5,340,305

[45] Date of Patent: Aug. 23, 1994

[54] LOW NOX GAS BURNER

[76] Inventor: John V. Joyce, 19 Minkara Road, Bayview, N.S.W., Australia, 2104

[21] Appl. No.: 891,155

[22] Filed: May 28, 1992

Related U.S. Application Data

[62] Division of Ser. No. 598,021, Oct. 16, 1990, abandoned.

[30] Foreign Application Priority Data

Oct. 20, 1989 [AU] Australia ..... PJ7000

[51] Int. Cl.[5] ..... F23D 14/14

[52] U.S. Cl. ..... 431/7; 431/329

[58] Field of Search ..... 431/329, 7; 126/92 R, 126/92 AC

[56] References Cited

U.S. PATENT DOCUMENTS

| | | | |
|---|---|---|---|
| 3,040,805 | 6/1962 | Lambert . | |
| 3,084,736 | 4/1963 | Mentel et al. . | |
| 3,122,197 | 2/1964 | Saponara et al. . | |
| 3,169,572 | 2/1965 | Constance et al. . | |
| 3,185,204 | 5/1965 | Loeb et al. . | |
| 3,353,583 | 11/1967 | Silhavy et al. . | |
| 3,360,028 | 12/1967 | Saponara et al. . | |
| 3,363,662 | 1/1968 | Curtis . | |
| 3,401,000 | 9/1968 | Spaonara et al. | 431/329 |
| 3,726,633 | 4/1973 | Vasilakis et al. | 431/329 |
| 3,729,285 | 4/1973 | Schedersky | 431/8 |
| 3,814,573 | 6/1974 | Karlovetz | 431/329 |
| 3,857,670 | 12/1974 | Karlovetz et al. | 431/329 |
| 3,907,488 | 9/1975 | Takahashi et al. | 431/2 |
| 4,289,474 | 9/1981 | Honda et al. | 431/10 |
| 4,480,988 | 11/1984 | Okabayashi et al. | 431/329 |
| 4,599,066 | 7/1986 | Granberg | 431/329 |
| 4,657,506 | 4/1987 | Ihlenfield et al. | 431/329 |
| 4,927,355 | 5/1990 | Haire et al. | 431/329 |
| 5,101,806 | 4/1992 | Hunt et al. | 431/329 |

FOREIGN PATENT DOCUMENTS

| | | | |
|---|---|---|---|
| 627548 | 5/1963 | Belgium . | |
| 1577719 | 8/1969 | France . | |
| 580932 | 8/1958 | Italy | 431/329 |
| 46536 | 4/1977 | Japan | 431/329 |
| 52-46538 | 4/1977 | Japan . | |
| 53-13299 | 9/1978 | Japan . | |
| 57-155012 | 9/1982 | Japan . | |
| 57-164213 | 10/1982 | Japan . | |
| 60-175913 | 9/1985 | Japan . | |
| 60-175914 | 9/1985 | Japan . | |
| 84 01992 | 5/1984 | PCT Int'l Appl. . | |
| 741660 | 12/1955 | United Kingdom . | |
| 982376 | 2/1965 | United Kingdom . | |
| 2120711 | 12/1983 | United Kingdom . | |
| 2201506 | 9/1988 | United Kingdom . | |
| 2224822 | 5/1990 | United Kingdom . | |

OTHER PUBLICATIONS

Journal Of The Institute of Energy, Dec. 1988, pp. 184–188, vol. 61; "NOx Emissions From Radiant Gas Burners", Barnes et al.

Journal Of The Institute Of Energy, Jun. 1989, pp. 89–93, vol. 62; "Simultaneous Reduction of NO2 and CO in a Domestic Unvented Gas-fired Convective Heater", Arai et al.

*Primary Examiner*—Carroll B. Dority

*Attorney, Agent, or Firm*—Pearne, Gordon, McCoy & Granger

[57] ABSTRACT

A gas burner apparatus including plenum chamber having a combustion surface formed from a conductive porous heat resistant material, a fuel supply, an air/gas mixing and delivery device extending into the chamber, the delivery device being adapted to supply an air/gas mixture with an air component at least equal to that required for theoretical complete combustion, and a fuel delivery system for delivering fuel from the fuel supply to achieve a predetermined combustion temperature at the combustion surface selected so as to reduce the formation of oxides of nitrogen in the products of combustion to about 5 ng/Joule or below.

12 Claims, 7 Drawing Sheets

LOW NOX GAS BURNER

This application is a division of application Ser. No. 07/598,021 filed Oct. 16, 1990 and now abandoned.

FIELD OF THE INVENTION

The present invention relates to burners and in particular to burners producing low emission levels of oxides of nitrogen. The invention has been developed primarily for use in flueless convection gas-fired space heaters, and will be described with reference to this particular application. However, it will be appreciated from the discussion herein that the invention is not limited to this particular field of use.

BACKGROUND OF THE INVENTION

Unvented gas-fired burners are widely used as space heaters in dwellings and other buildings. Their thermal efficiency comes from their ability to reduce air infiltration rates, but they can be a source of indoor pollution especially in the amount of $NO_X$ formed particularly $NO_2$.

$NO_X$ is a term used to describe the combine d "Oxides of Nitrogen" in particular NO, $N_2$, and $NO_2$. NO and $N_2O$ for example are a concern in the outdoor environment, in particular with relation to acid rain, ozone and photochemical smog $NO_2$, however, is of more concern to medical authorities due to the effect it has on lung function.

Medical research during the 1980's has suggested that much lower levels of $NO_2$ will affect lung function than was previously thought. Until recently in New South Wales, Australia, for example, a 3 ppm upper limit per 8 hours of $NO_2$ was considered safe and in the United States of America the figure was 5 ppm per 8 hours. However, the Public Health Committee of the National Health and Medical Research Council in Canberra, Australia, after considering all the new available medical data has decided that a level above 0.3 ppm give(s) reason for concern and the World Health Organization has now set a goal of 0.21 ppm (not to be exceeded for more than one hour per month).

Furthermore, in the outdoor environment general concern is increasing over the levels of $NO_X$ in both the lower and upper atmosphere and various authorities around the world are introducing legislation to control emissions in combustion products. These new targets and accompanying legislation are going to have a dramatic impact on the gas burner market as a whole.

Gas burners in general are of two types—the blue flame burner and surface combustion (radiant) burners. The type most commonly used in convection space heaters is the blue flame burner as they operate at a lower temperature than the surface combustion burners, making them safer for use in schools or the home. However, it is well established that blue flame burners generally produce $NO_2$ in the levels in the order of 15 to 30 ng/Joule and as such are not considered to have potential for the reduction of $NO_X$. For this reason, research into producing low burners has centered primarily around surface combustion burners of different forms.

In the last twenty years, research into the production of burners having lower $NO_X$ emission levels has concentrated on the use of excess air, alone or in combination with the incorporation of second stage burning. As a result, a number of these burners have become very complex in both design and operation procedures.

For example, the most successful to date have centered on using pressurized premixed air/flue mixtures burnt in a variety of metallic surface configurations, ceramic surfaces or after burners. All have relied on high excess air and high combustion load. In fact, burners with low combustion load were considered undesirable. Additionally, low pressure burners using high excess air while not using an air pump of some kind had not previously been considered acceptable, due to problems experienced with flashback.

Whilst reduction in $NO_X$ emission levels have been achieved relative to the older types of burners, it still appears that it has hitherto not been possible to even approach the new target levels considered desirable.

SUMMARY OF THE INVENTION

Accordingly, it is an object of the present invention to provide a low $NO_X$ burner of simple construction and flexibility of operation that overcomes or substantially ameliorates the above-discussed disadvantages of the prior art.

According to one aspect of the invention, there is provided a gas burner apparatus including plenum chamber having a combustion surface formed from a conductive porous heat resistant material, a fuel supply, an air/gas mixing and delivery device extending into said chamber, the delivery device being adapted to supply an air/gas mixture with an air component at least equal to that required for theoretical complete combustion, and a fuel delivery system for delivering fuel from the fuel supply to achieve a predetermined combustion temperature at said combustion surface selected so as to reduce the formation of oxides of nitrogen in the products of combustion to about 5 ng/Joule or below.

Preferably the burner is naturally aspirated.

Preferably also the combustion temperature at said combustion surface is in the range of 600°-900° C.

Desirably the combustion surface is formed from one or more layers of mesh material. In preference, the surface comprises three tightly secured layers of 30×32×0.014" nickel-based steel mesh of 32% porosity.

Through a series of experiments, it has been shown that the invention overcomes the previous constraints by providing a combination of low combustion load, low temperature and a slowing of the combustion process indicated by a low port loading for a given burner. This combination, it is thought, allows complete combustion to take place resulting in low levels of CO emission, i.e. 0.002 $CO/CO_2$ making the burner suitable for unvented indoor use, whilst maintaining temperature levels within a zone which inhibits the formation of NO. Constraining the production of NO which, under certain conditions converts to $NO_2$, is believed to assist in the reduction of all types of oxides of nitrogen to levels previously thought unobtainable.

Ordinary surface combustion burners have usually been designed to operate at stoichiometric (100%) air/fuel ratio. Generally, this gives the most efficient conversion of heat and provides the highest operating temperatures. However, for these same reasons, it has also been considered the worst condition in which to operate a burner if it was necessary to try and reduce the levels of $NO_X$ emission.

Accordingly, it is surprising to note that although the burner hereinafter described makes use of excess air amongst other methods to suppress the combustion temperature levels, experiments have shown that the burner may be operated at stoichiometric conditions and still produce extremely low levels of $NO_X$. However, the burner in this form is not as compact per $MJ/m^2hr$ as when operated with levels of excess air.

It is also interesting to note that low pressure burners using high excess air while not using an air pump of some kind had not previously been considered acceptable, due to problems experienced with flashback.

The results have shown that it is possible to produce a surface combustion burner that has emission levels from the flue products low enough to meet an indoor air quality of 0.1 ppm.

DESCRIPTION OF PREFERRED EMBODIMENT

Figure 1:
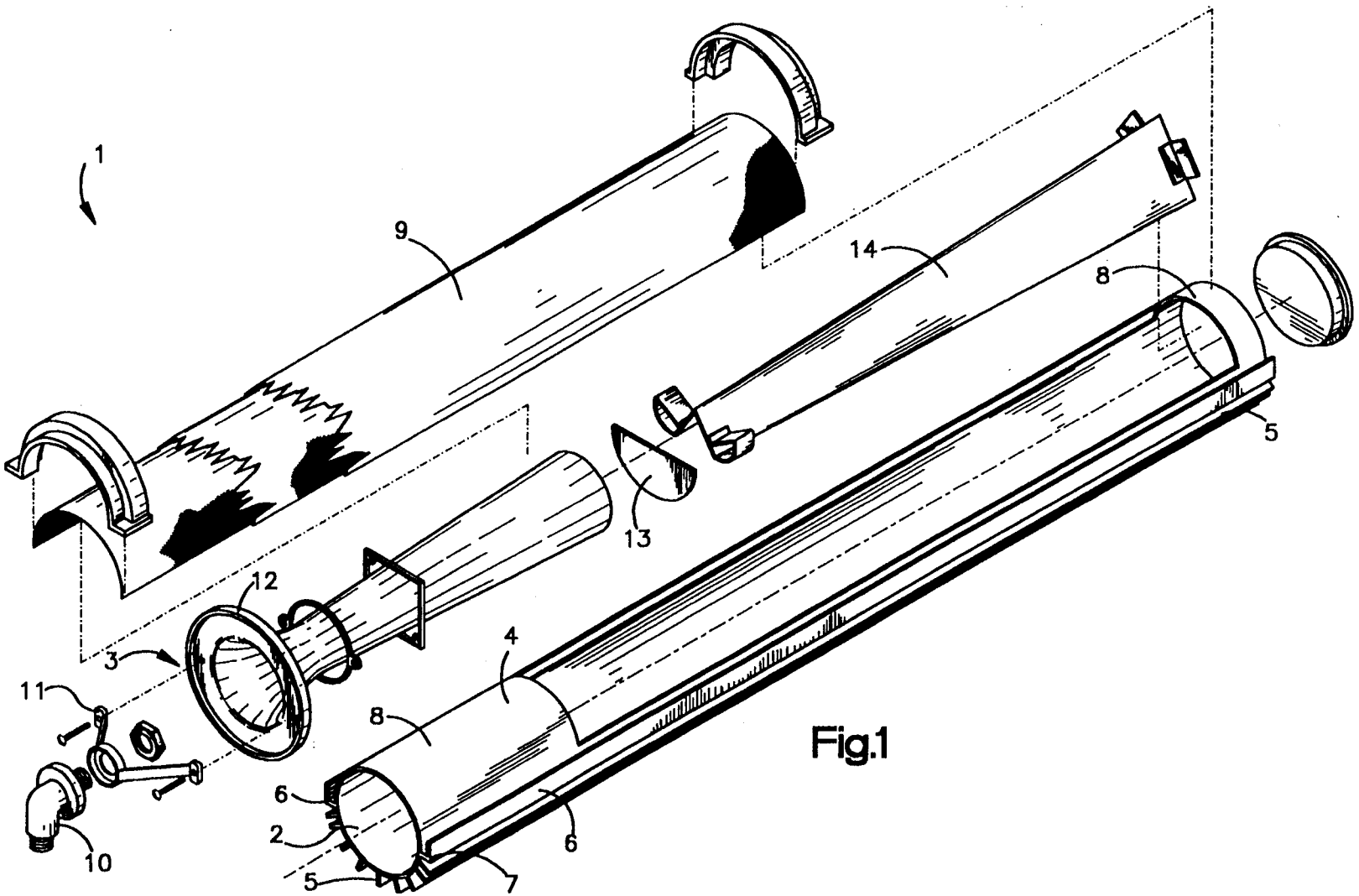
FIG. 1 is a schematic exploded view of a first embodiment of a gas burner according to the invention suitable for use in a convection space heater.
Figure 2:
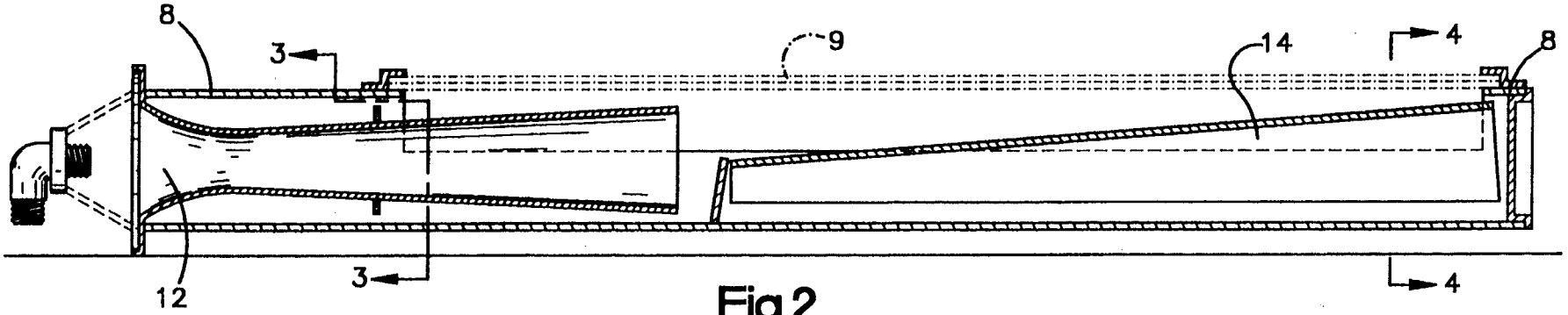
FIG. 2 is a longitudinal sectional side view of the assembled gas burner shown in FIG. 1.
Figure 4:
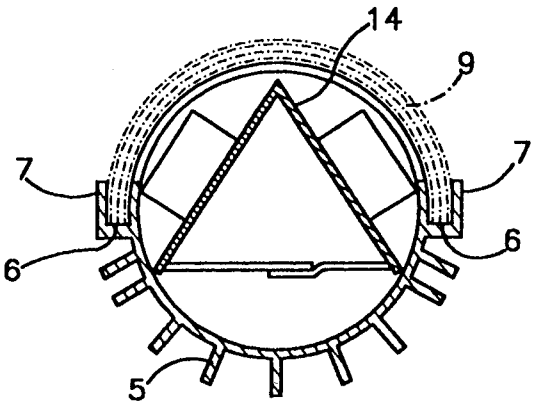
FIG. 4 is a transverse sectional end view taken on line 4—4 of FIG. 2.
Figure 3:
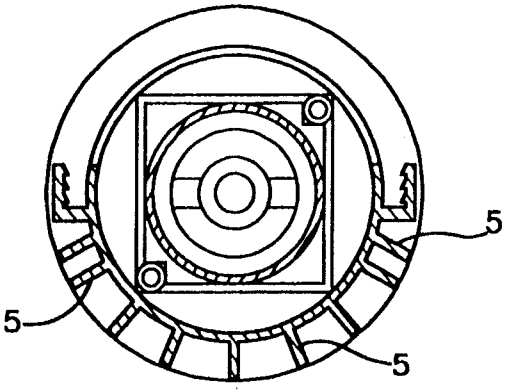
FIG. 3 is a transverse sectional end view of the burner taken on line 3—3 of FIG. 2.

Two preferred embodiments of the invention will now be described, by way of example only, with reference to the accompanying drawings.

Referring to the drawings, the burner 1 comprises a substantially tubular plenum chamber shown generally at 2, having at one end an air mixing and delivery device shown generally at 3. The plenum chamber 2 is formed from a substantially cylindrical extruded aluminum body 4 having a plurality of longitudinally extending cooling fins 5 extending radially outwards from one longitudinal half of its surface. Two gutters 6 also extend longitudinally on diametrically opposite sides of the tube, each having a deformable lip 7 which is serrated on its innermost surface. The portion of the body 4, not having fins 5, is cut away bar two short lengths 8 one at each end of the tube, which serve as a framework to which the other components are secured.

The other half of chamber 2 is formed from three superimposed layers of heat resistant radiant mesh material 9. The mesh layers 9 are firmly compressed, formed into shape to correspond with body 4 and secured in gutters 6 by crimping lips 7 inwardly. The serrations grip the mesh 9 to provide a high strength connection with body 4. Sealing of this connection is unnecessary as any leakage would be consumed as it passed the flame front.

The air mixing device 3 comprises a gas injector nozzle 10 attached by means bracket 11 to a venturi 12. At the end of venturi 12 distal to the injector 10, there is provided a substantially semi-circular baffle 13 secured to the wall of the aluminum body 4.

A tapered spreader baffle 14 extends from immediately behind the semi-circular baffle 13 up to the end of the plenum chamber 2. This baffle serves to evenly distribute the air/gas mixture along the burner at a substantially constant pressure level so that the mixture burns evenly along the length of the burner.

In use, the gas is injected into the mouth of the venturi, drawing and mixing with the ambient air provides a variable air/gas mixture. Combustion of the mixture takes place through the layers of mesh material.

In order to prevent "hot spots" and to keep the combustion temperatures low and even, it is important that the layers of mesh remain tightly secured. It has been found that warping of the mesh can be prevented by cutting the mesh on the cross to ensure all mesh filaments are of an even length thereby preventing warping through differential expansion.

Importantly, the layers of mesh material are preferably positioned one relative to another such that the openings in each layer do not align and are not in registry with openings in an adjacent layer. In other words, there is no direct path through the openings between the outer combustion surface of mesh layers 9 and plenum chamber 2. In this respect, subsequent layers of mesh act as a barrier to reflected waves of radiant energy (from the surface of the object to be heated) to prevent the reflected energy from entering the plenum chamber and overheating the burner. Importantly, the outer combustion surface of burner 1 may also be formed of a single layer of mesh, or other material, having openings therethrough dimensioned so as to create a labyrinth to prevent reflected infrared energy from being returned to the burner plenum from an adjacent object.

The dimensions and ratings of this first embodiment will now be described.

| SPECIFICATION | |
|---|---|
| Burner Energy Rating | 19,900 Btu |
| Chamber Size Diameter | 1.97" (internal) |
| Effective length | 23.6" |
| Mesh material | 'Inconel' - wire diameter 0.014 ins. Woven mesh 32 × 30 transverse strands per square inch. |
| Effective Mesh Area | (18.5 × 3.27) 60.6 $in^2$ |
| Excess Air | 28% |
| Baffle Angle | 80° with bracket |
| Baffle Position | 1.06" from venturi exit |
| Venturi Throat Diameter | 1.024" |

-continued

| | |
|---|---|
| Intake Radius | 3.0" |
| Length From Throat To Exit | 6.142" (4° included angle) |
| Average Combustion Temperature | 850° C. |
| EMISSION LEVELS | |
| $NO_2$ | 1.8 ng/Joule |
| Ratio $CO/CO_2$ | 0.001–0.003 |

The design is substantially scaleable to produce burners of various energy ratings.

After commencement of the tests, it was decided to construct a second embodiment of the burner having the same energy rating and general specification with the same combustion surface area, only this time with a substantially planar or flat combustion surface to compare its operation with the convex embodiment.

The following experimental results were obtained which serve to illustrate, without limiting the invention.

These embodiments of the burner have shown to be capable of producing levels of nitrogen dioxide well below those levels considered to be normal for standard burners. The standard blue flame burner currently used in commercial gas space heaters produce levels of nitrogen dioxide in the order of 15–20 ng/Joule, whereas a low-$NO_X$ burner according to the present invention can produce levels as low as 1 ng/Joule.

The object of the testing was to produce a means of defining the operating conditions of the low-$NO_X$ burner to effect a predetermined emission of nitrogen dioxide.

The Australian Gas Association procedures were used to measure appliance emissions in a form relative to the burner output. All $NO_X$ levels were measured using Monitor Labs nitrogen oxides analyzer model 8840 and are, therefore, subject to the accuracy and inherent limitations of such an instrument.

The nitrogen dioxide level can be expressed in units of nanograms per Joule (ng/J) which, in turn, will relate to room size. This will indirectly control the $NO_2$ levels within a room where an unflued appliance is being operated. The levels measured within any given room will, therefore, vary on the size of that room; the ventilation; the content of the room; the absorption of nitrogen dioxide into walls; and, the background level of $NO_2$. Accordingly, because of this variability, a fairly complex model was required to provide an accurate account for the level of $NO_2$ within a given room.

To evaluate the levels of emission, the burner was mounted to a rig beneath a sampling hood. The background levels of nitrogen dioxide and carbon dioxide were taken and later deducted from the burner sample levels. Below is a summary of the formulae used and assumptions made in determining the results that follow.

Units Formulae and Assumptions $$\text{Nitrogen Dioxide } (NO_2)\ \text{ng/J} = \frac{195 \times (Y2 - Y1) \times C}{(X2 - X1) \times H}$$

Where $Y1$ = concentration of $NO_2$ in the intake air in ppm (V/V)
Where $Y2$ = concentration of $NO_2$ in the exit gases in ppm (V/V)
Where $C$ = volume of $CO_2$ produced per unit volume of gas when completely combusted and when both the gas and $CO_2$ are measured at MSC (Metric Standard Conditions)
Where $X1$ = concentration of $CO_2$ in the intake air in % (V/V)
Where $X2$ = concentration of $CO_2$ in the exit gases in % (V/V)
Where $H$ = gross heating value of the gas in $MJ/m^3$ at MSC (dry)

-continued

Units Formulae and Assumptions $$\text{Excess Air } (Ae) = \left[\frac{A.F.R.}{\text{Stoichiometric air/gas ratio}}\right] - 1 \times 100\%$$

$$\text{Where } A.F.R. = \text{Air Fuel Ratio} = \frac{x}{20.93 - x}$$

Stoichiometric air/gas ratio for natural gas = 9.44 (V/V)

$$\text{Therefore } Ae = \left[\frac{x}{(9.44 \times 20.93) - (9.44 \times X)}\right] - 1 \times 100\%$$

$$Ae = \left[\left[\frac{x}{197.58 - 9.44X}\right] - 1\right] \times 100\%$$

Temperature measurement was achieved by means of a surface probe of Ni—Al type. The probe tip was allowed to rest in contact with the surface of the mesh. The flame height above the mesh of the burner during normal operation is about 1.5–2.0 mm high and the Ni—Al surface probe is of 1/16" diameter (1.587 mm) wire. With this criteria, the assumption has been made that the temperatures obtained in experiments are of a mean mesh/flame temperature.

In some instances, the burners were overloaded intentionally. In such cases, a flame breaks from the mesh surface and a secondary stage of combustion takes place. The temperature of this flame was again measured with the surface probe and found to be in the order of 900° C. The burner loading was then determined as follows:

$$\text{Burner loading } (MJ/m^2hr) = \frac{\text{Determined gas rate} \times \sqrt{Pi}}{A}$$

Where determined gas rate is measured in MJ/hr
Pi= pressure at the injector (kPa)
A= surface area of mesh ($m^2$)

As described, the burner mesh is of Inconel material consisting of approximately 60% nickel with a weave specification of 30×32×0.014". Three layers of mesh were used in the burner construction, these layers being held in compression to effect a minimal void between the layers.

The low-$NO_X$ burner was set in a number of operating conditions as described below and samples of the emissions for each condition were taken.

RESULTS

Tests commenced on the 30MJ standard cylindrical burner described having a 2.45 mm injector nozzle. The aim of this first test was to determine the effect of temperature with regard to emission levels of the various pollutants. The temperature was varied by allowing the burner loading to rise by increasing the pressure of the gas to the injector. The results are set out below in Table 1 from which it will be seen that the $NO_X$ emissions increased with increasing temperature but nonetheless were very low throughout the test. The limiting factor appeared to be the minimum loading at which good combustion could still be achieved.

TABLE 1

| TEMP °C. | $NO_2$ (ng/J) | PRESSURE kPa | BURNER LOADING MJ/m²hr | $CO_2$ | $CO/CO_2$ |
|---|---|---|---|---|---|
| 650 | 1.99 | 0.2 | 260.3 | 0.9 | .03 |
| 700 | 2.133 | 0.3 | 318.8 | 1.2 | .0137 |
| 750 | 2.63 | 0.45 | 390.4 | 1.32 | .0056 |
| 800 | 2.68 | 0.68 | 479.9 | 1.75 | .0020 |
| 850 | 2.434 | 1.00 | 582.0 | 2.06 | .0010 |

Determined gas rate at 1 kPa = 28.72 MJ
Ambient $NO_2$ = 0.105 ppm
Ambient $CO_2$ = 0.055%
Injector Size = 2.45 mm The test was then repeated on the same burner but using smaller increments of increased pressure in order to refine the data. The results are set forth in Table 2.

TABLE 2

| TEMP °C. | MEASURED $NO_2$ (ng/J) | PRESSURE kPa | MJ/m²hr | NO | $A_E$ | $CO_2$ | $CO/CO_2$ |
|---|---|---|---|---|---|---|---|
| 700 | 2.144 | 0.45 | 390.4 | 0 | 10% | 1.04 | 0.01 |
| 710 | 2.196 | 0.50 | 411.5 | 0 | 10% | 1.04 | 0.01 |
| 730 | 2.104 | 0.51 | 415.6 | 0 | 10% | 1.11 | 0.006 |
| 760 | 2.107 | 0.67 | 476.4 | 0 | 17% | 1.26 | 0.004 |
| 780 | 2.56 | 0.72 | 493.8 | 0 | 17% | 1.28 | 0.003 |
| 790 | 2.626 | 0.75 | 504.0 | 0 | 25% | 1.33 | 0.003 |
| 800 | 2.647 | 0.82 | 527.0 | 0 | 25% | 1.37 | 0.0025 |
| 820 | 2.475 | 0.90 | 552.1 | 0 | 25% | 1.41 | 0.002 |
| 825 | 2.536 | 0.95 | 567.2 | 0 | 25% | 1.45 | 0.0018 |
| 835 | 2.537 | 1.00 | 582 | 0 | 25% | 1.46 | 0.0017 |
| 840 | 2.560 | 1.10 | 610.4 | 0 | 35% | 1.52 | 0.0015 |

Determined gas rate at 1 kPa = 28.72 MJ
Ambient $NO_2$ = 0.080 ppm
Ambient $CO_2$ = 0.02%
Injector Size = 2.45 mm Still using the same basic burner, the injector was replaced with a larger nozzle of 3.00 mm and again the pressure of the gas was varied to determine the effect on temperature and thereby monitor variations in pollutant emission levels. It can be seen that the burner output at 1 kPa gas rate was substantially higher at almost 48 MJ. This resulted in overall increased temperatures and $NO_X$ emission although viewed with respect to existing burners increased temperatures and $NO_X$ emission although viewed with respect to existing burners the emission levels were still surprisingly low.

TABLE 3

| TEMP °C. | MEASURED $NO_2$ (ng/J) | PRESSURE kPa | MEASURED NO (P.P.M.) | MJ/m²hr | $CO_2$ | $CO/CO_2$ |
|---|---|---|---|---|---|---|
| 850 | 4.547 | 0.40 | 1.1 | 613 | 1.16 | .001 |
| 860 | 4.533 | 0.44 | 1.3 | 643 | 1.24 | .001 |
| 870 | 4.516 | 0.50 | 1.25 | 685 | 1.26 | .0007 |
| 880 | 4.607 | 0.52 | 1.4 | 699 | 1.33 | .0007 |
| 890 | 4.780 | 0.58 | 1.55 | 738 | 1.39 | .0006 |
| 900 | 4.602 | 0.68 | 1.65 | 799 | 1.50 | .0006 |
| 910 | 4.636 | 0.74 | 1.8 | 833 | 1.57 | .0005 |
| 920 | 4.683 | 0.75 | 2.0 | 839 | 1.60 | .0005 |
| 930 | 4.820 | 0.78 | 2.0 | 856 | 1.60 | .0005 |

Determined gas rate at 1 kPa = 47.83 MJ
Ambient $NO_2$ = 0.090 ppm
Ambient $CO_2$ = 0.04%
Injector Size = 3.00 mm The burner injector was then changed back to the standard 2.45 mm nozzle. Tests were repeated varying the pressure in increments, but this time the air mixture was adjusted at each stage such that the mixture remained at stoichiometric throughout the test whilst the temperatures varied. It is clear from the result, shown below in Table 4, that the temperature overall was high due to the lack of cooling effect from the inherent excess air but that overall again the emission levels were surprisingly low.

TABLE 4

| TEMP °C. | $NO_2$ (ng/J) | PRESSURE kPa | MJ/m²hr | $CO_2$ | $CO/CO_2$ |
|---|---|---|---|---|---|
| 720 | 2.747 | 0.44 | 386 | 1.01 | .0097 |
| 740 | 3.077 | 0.5 | 411.5 | 1.06 | .0074 |
| 760 | 3.474 | 0.55 | 431.6 | 1.11 | .0057 |
| 780 | 3.432 | 0.6 | 450.8 | 1.17 | .0045 |
| 795 | 3.45 | 0.65 | 469.2 | 1.21 | .0037 |
| 820 | 3.235 | 0.75 | 504 | 1.30 | .0025 |
| 835 | 4.353 | 0.8 | 520.5 | 1.38 | .0020 |
| 850 | 4.374 | 0.85 | 536.5 | 1.14 | .0018 |
| 860 | 4.694 | 0.9 | 552.1 | 1.44 | .0017 |
| 875 | 4.803 | 1.0 | 582 | 1.53 | .0015 |
| 880 | 4.827 | 1.1 | 610.4 | 1.60 | .0012 |

Determined gas rate at 1 kPa = 28.72 MJ
Ambient $NO_2$ = .08 ppm
Ambient $CO_2$ = 0.02%
Injector Size = 2.45 mm Accordingly, it was decided that the next test should determine the effect of the percentage air component whilst maintaining the gas pressure at a constant level. The test was conducted on the standard burner with the 2.45 mm injector nozzle. The results are shown below in Table 5.

TABLE 5

| EXCESS AERATION | MEASURED $NO_2$ (ng/J) | NO | $CO_2$ | $CO/CO_2$ |
|---|---|---|---|---|
| −16% | 6.285 | 1.2 | 1.7 | .0008 |
| 17% | 3.46 | 0.1 | 1.56 | .0016 |
| 35% | 2.249 | 0 | 1.49 | .0017 |

Determined gas rate at 1 kPa = 28.72 MJ
Ambient $NO_2$ = 0.08 ppm
Ambient $CO_2$ = 0.02%
Injector Size = 2.45 mm The above test was then repeated this time keeping the temperature constant at 820° C. and again varying the percentage air supply. The results are as shown in Table 6 below.

TABLE 6

| EXCESS AERATION | MEASURED $NO_2$ (ng/J) | NO | $CO_2$ | $CO/CO_2$ |
|---|---|---|---|---|
| −15% | 7.07 | 1.0 | 1.61 | 0.0009 |
| −2% | 6.013 | 0.3 | 1.51 | 0.0014 |
| 17% | 3.14 | 0 | 1.38 | .0022 |
| 25% | 2.85 | 0 | 1.41 | .0017 |
| 35% | 2.501 | 0 | 1.47 | .0018 |

Determined gas rate at 1 kPa = 28.72 MJ
Ambient $NO_2$ = 0.08 ppm
Ambient $CO_2$ = 0.02%
Injector Size = 2.45 mm It was then decided to reduce the burner output by using a smaller 2.1 mm jet such that at 1 kPa gas pressure the output was around 23 MJ, and the above aeration tests were repeated. The effects are illustrated in Table 7 below.

TABLE 7

| EXCESS AERATION | MEASURED $NO_2$ (ng/J) | NO | $CO_2$ | $CO/CO_2$ |
|---|---|---|---|---|
| −38% | 9.766 | 0 | 1.18 | .0041 |
| STOICHIOMETRIC | 5.134 | 0 | 1.17 | .0038 |
| 20% | 2.766 | 0 | 1.16 | .005 |
| 37% | 2.215 | 0 | 1.14 | .0048 |

Determined gas rate at 1 kPa = 22.99 MJ
Ambient $NO_2$ = 0.44 ppm
Ambient $CO_2$ = 0.03%
Injector Size = 2.1 mm The last test was repeated again with an even smaller 1.85 mm nozzle such that the burner output at 1 kPa gas pressure was around 18 MJ. The results are shown below.

TABLE 8

| EXCESS AERATION | MEASURED $NO_2$ (ng/J) | NO | $CO_2$ | $CO/CO_2$ |
|---|---|---|---|---|
| −37% | 6.702 | 0 | 0.91 | .0116 |
| −12% | 5.129 | 0 | 0.92 | .0125 |
| 6% | 2.792 | 0 | 0.92 | .0134 |
| 47.5% | 1.966 | 0 | 0.86 | .0177 |
| 80% | 1.966 | 0 | 0.86 | .0183 |

Determined gas rate at 1 kPa = 17.63 MJ
Ambient $NO_2$ = 0.44 ppm
Ambient $CO_2$ = 0.03%
Injector Size = 1.85 mm As it appeared clear at this stage that the mesh was playing a significant role in reducing the combustion temperature, it was decided to try altering the thickness or number of layers of mesh. Previous tests with only two layers of the mesh available were unsuccessful due to the "blow back" of the flame front that was experienced. However, it was thought that use of a different mesh gauge and/or weave would overcome this problem although time constraints precluded such further tests at this stage.

Accordingly, the next steps conducted used four layers of the previously used mesh. The first test was on the standard burner using a 3 mm nozzle and the pressure was raised in the same way as discussed in relation to Table 3. The results are shown below.

TABLE 9

| TEMP °C. | $NO_2$ (ng/J) | PRESSURE kPa | NO (PPM) | $CO_2$ | $CO/CO_2$ |
|---|---|---|---|---|---|
| 780 | 5.433 | 0.3 | 0 | 1.46 | .0011 |
| 805 | 5.266 | 0.4 | 1.8 | 1.63 | .0008 |
| 830 | 5.168 | 0.5 | 2.15 | 1.78 | .0007 |
| 850 | 4.935 | 0.6 | 2.5 | 1.96 | .0006 |
| 870 | 4.524 | 0.7 | 2.7 | 2.10 | .0005 |

Determined gas rate at 1 kPa = 41.62 MJ
Ambient $NO_2$ = 0.44 ppm
Ambient $CO_2$ = 0.03%
Injector Size = 3.0 mm The nozzle was then changed back to the 2.45 mm standard injection and the above test repeated. The results are shown in Table 10 below.

TABLE 10

| TEMP °C. | $NO_2$ (ng/J) | PRESSURE kPa | NO (PPM) | $CO_2$ | $CO/CO_2$ |
|---|---|---|---|---|---|
| 710 | 4.230 | 0.32 | 0 | 0.92 | 0.128 |
| 750 | 4.737 | 0.45 | 0 | 1.05 | .0065 |
| 770 | 4.526 | 0.52 | 0.05 | 1.18 | .0038 |
| 790 | 4.249 | 0.66 | 0.1 | 1.28 | .0024 |
| 810 | 3.945 | 0.8 | 0.15 | 1.39 | .0017 |
| 830 | 3.625 | 1.0 | 0.2 | 1.51 | .0013 |
| 860 | 3.29 | 1.1 | 0.4 | 1.58 | .0010 |

Determined gas rate at 1 kPa = 28.76 MJ
Ambient $NO_2$ = 0.44 ppm
Ambient $CO_2$ = 0.03%
Injector Size = 2.45 mm The test was repeated once more using the larger 3.5 mm nozzle and the results are recorded below.

TABLE 10A

| TEMP °C. | $NO_2$ (ng/J) | PRESSURE kPa | $CO_2$ | $CO/CO_2$ |
|---|---|---|---|---|
| 740 | 5.145 | 0.58 | 1.85 | .0005 |
| 780 | 5.49 | 0.5 | 2.15 | .0004 |
| 800 | 5.423 | 0.4 | 2.27 | .0005 |

TABLE 10A-continued

| TEMP °C. | $NO_2$ (ng/J) | PRESSURE kPa | $CO_2$ | $CO/CO_2$ |
|---|---|---|---|---|
| 825 | 5.145 | 0.3 | 2.42 | .0006 |

Determined gas rate at 1 kPa = 60.91 MJ
Ambient $NO_2$ = 0.44 ppm
Ambient $CO_2$ = 0.03%
Injector Size = 3.5 mm It was then decided to test the effect of five layers of mesh. Again the first test commenced using a 3 mm injector and the results are shown below.

TABLE 11

| TEMP °C. | $NO_2$ (ng/J) | PRESSURE kPa | NO (PPM) | $CO_2$ | $CO/CO_2$ |
|---|---|---|---|---|---|
| 750 | 5.006 | 0.3 | 0.8 | 1.4 | .0012 |
| 800 | 4.447 | 0.4 | 1.0 | 1.62 | .0008 |
| 820 | 4.387 | 0.5 | 1.7 | 1.80 | .0006 |
| 840 | 4.006 | 0.6 | 1.8 | 1.98 | .0005 |
| 855 | 4.219 | 0.7 | 2.05 | 2.06 | .0005 |
| 875 | 4.146 | 0.75 | 2.15 | 2.16 | .0005 |

Determined gas rate at 1 kPa = 41.62 MJ
Ambient $NO_2$ = 0.44 ppm
Ambient $CO_2$ = 0.03%
Injector Size = 3 mm The injector was then converted back to the standard 2.45 mm nozzle and the test repeated. The results are shown in Table 12 below.

TABLE 12

| TEMP °C. | $NO_2$ (ng/J) | PRESSURE kPa | NO (PPM) | $CO_2$ | $CO/CO_2$ |
|---|---|---|---|---|---|
| 675 | 3.603 | 0.3 | 0 | 0.89 | .0154 |
| 715 | 3.387 | 0.4 | 0 | 1.11 | .0080 |
| 735 | 3.387 | 0.5 | 0 | 1.11 | .0057 |
| 755 | 3.204 | 0.6 | 0 | 1.21 | .0034 |
| 770 | 3.07 | 0.7 | 0 | 1.26 | .0028 |
| 785 | 3.144 | 0.8 | 0 | 1.38 | .0021 |
| 795 | 3.027 | 0.9 | 0.05 | 1.45 | .0019 |
| 800 | 3.084 | 1.0 | 0.1 | 1.51 | .0016 |
| 810 | 2.964 | 1.1 | 0.1 | 1.57 | .0015 |

Determined gas rate at 1 kPa = 28.76 MJ
Ambient $NO_2$ = 0.44 ppm
Ambient $CO_2$ = 0.03%
Injector Size = 2.45 mm In order to dispel any thoughts that the reduction in $NO_X$ was somehow related to the "nickel" component of the mesh, the test was repeated again using a fairly standard stainless steel mesh of similar weave and gauge. The results shown below do not vary significantly from those achieved using the "Inconel" mesh.

TABLE 13

| TEMP °C. | $NO_2$ (ng/J) | PRESSURE kPa | NO (PPM) | $CO_2$ | $CO/CO_2$ |
|---|---|---|---|---|---|
| 695 | 2.583 | 0.3 | 0 | 0.92 | .0162 |
| 715 | 2.782 | 0.4 | 0 | 1.00 | .0096 |
| 730 | 2.844 | 0.5 | 0 | 1.11 | .0055 |
| 755 | 2.717 | 0.6 | 0 | 1.19 | .0043 |
| 770 | 2.587 | 0.7 | 0 | 1.30 | .0021 |
| 775 | 2.507 | 0.8 | 0 | 1.37 | .0021 |
| 785 | 2.388 | 0.9 | 0 | 1.44 | .0018 |
| 800 | 2.292 | 1.0 | 0 | 1.44 | .0012 |
| 810 | 2.196 | 1.1 | 0 | 1.55 | .0013 |

Determined gas rate at 1 kPa = 28.76 MJ
Ambient $NO_2$ = 0.44 ppm
Ambient $CO_2$ = 0.03%
Injector Size = 2.45 mm It was at this stage that it was decided to construct and test a prototype equivalent flat burner. The tabulated results of the tests are shown below. In both tests it was only the gas pressure that was altered directly in order to effect a corresponding change in temperature. The results in Table 14 relate to a flat burner and those in Tables 15 and 16 relate to round burners. The results in Tables 14 and 16 were obtained using natural gas and those in Table 15 were obtained using L.P.G.

TABLE 14

| | | | FLAT BURNER | | | |
|---|---|---|---|---|---|---|
| TEMPERATURE AT MESH °C. | $NO_2$ ng/J | NO | PRESSURE AT INJECTOR | $CO_2$ % | $CO/CO_2$ | $MJ/m^2hr$ SURFACE LOADING |
| 850 | 3.26 | 0 | 1.0 | 1.32 | .0009 | 580 |
| 840 | 3.43 | 0 | 0.9 | 1.22 | .001 | 551 |
| 835 | 3.06 | 0 | 0.8 | 1.17 | .0011 | 519 |
| 800 | 2.82 | 0 | 0.7 | 1.71 | .0008 | 486 |
| 770 | 2.66 | 0 | 0.6 | 1.60 | .0009 | 458 |
| 750 | 2.71 | 0 | 0.5 | 1.45 | .0010 | 410.5 |
| 730 | 2.66 | 0 | 0.4 | 1.33 | .0014 | 367 |
| 690 | 2.473 | 0 | 0.3 | 1.15 | .0027 | 318 |
| 640 | 1.89 | 0 | 0.24 | 1.00 | .007 | 284.4 |

Determined gas rate at 1 kPa = 28 MJ
Ambient $NO_2$ = 0.086 ppm
Ambient $CO_2$ = 0.02%
Natural Gas

TABLE 15

| | | | ROUND BURNER | | | |
|---|---|---|---|---|---|---|
| TEMPERATURE AT MESH °C. | $NO_2$ ng/J | NO | PRESSURE AT INJECTOR | $CO_2$ % | $CO/CO_2$ | $MJ/m^2hr$ SURFACE LOADING |
| 740 | 3.14 | 0 | 1.1 | 1.0 | .005 | 359 |
| 760 | 3.13 | 0 | 1.5 | 1.11 | .0045 | 419 |
| 780 | 3.10 | 0 | 2.05 | 1.29 | .002 | 490 |
| 790 | 3.06 | 0 | 2.26 | 1.23 | .0016 | 514 |
| 810 | 3.00 | 0 | 2.75 | 1.35 | .0013 | 567 |
| 820 | 2.6 | 0 | 2.95 | 1.51 | .0009 | 587 |
| 830 | 3.74 | 0 | 3.5 | 1.79 | .0009 | 640 |

Determined gas rate at 1 kPa = 28 MJ
Ambient $NO_2$ = 0.086 ppm
Ambient $CO_2$ = 0.02%
L.P.G.

TABLE 16

| | | | ROUND BURNER | | | |
|---|---|---|---|---|---|---|
| TEMPERATURE AT MESH °C. | $NO_2$ ng/J | NO | PRESSURE AT INJECTOR | $CO_2$ % | $CO/CO_2$ | $MJ/m^2hr$ SURFACE LOADING |
| 720 | 3.00 | 0 | 0.5 | 0.66 | .0086 | 409 |
| 750 | 2.75 | 0 | 0.7 | 0.77 | .0041 | 484 |
| 770 | 2.80 | 0 | 0.8 | 0.80 | .0025 | 517 |
| 780 | 2.70 | 0 | 1.0 | 0.89 | .0018 | 578 |
| 790 | 2.96 | 0 | 1.1 | 0.92 | .0018 | 606 |
| 800 | 2.80 | 0 | 1.2 | 0.96 | .0015 | 633 |

Determined gas rate at 1 kPa = 22 MJ
Ambient $NO_2$ = 0.086 ppm
Ambient $CO_2$ = 0.02%
Natural Gas As the results obtained on the flat burner in Table 14 looked promising, a further set of four tests were conducted in the same manner. The results of the tests were averaged and are shown in the Table below.

TABLE 17

| | | FLAT BURNER | | | |
|---|---|---|---|---|---|
| TEMP °C. | $NO_2$ (ng/J) | Pressure kPa | $MJ/m^2hr$ | $CO_2$ (%) | $CO/CO_2$ |
| 850 | 1.6 | 1.0 | 598 | 1.42 | .0005 |
| 835 | 1.8 | 0.75 | 519 | 1.23 | .001 |
| 750 | 1.8 | 0.5 | 423 | 1.38 | .0011 |

Determined gas consumption at 1 kPa = 29.55 MJ

Using the tabulated data disclosed, a series of graphs, shown in FIGS. 5–14, were generated to assist in interpretation of the results and enable the data to be used in the development of future burners.

In all the graphs, the curves are identified by reference numerals corresponding to the table number from which the data was extracted such that a curve identified as T1 corresponds to the result illustrated in Table 1. The column from which the data was taken will be evident from the variables designated to each of the axes of the graph. In all graphs, the units correspond to those given in the Tables.

Figure 5:
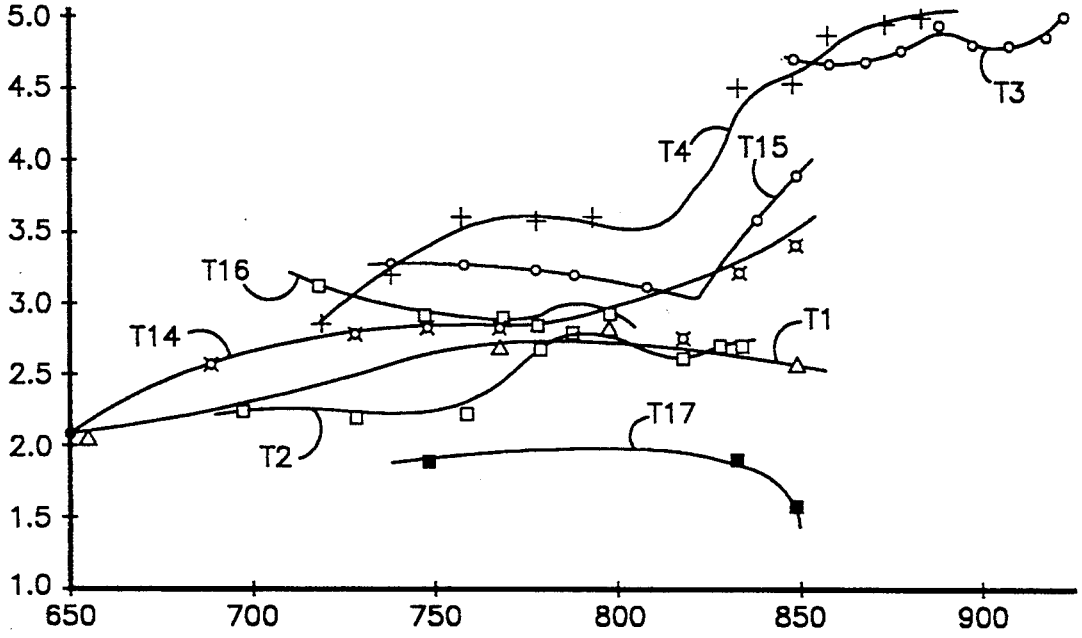
FIG. 5 is a graph showing the relationship between temperature and nitrogen dioxide emission levels for the first and second embodiment of the invention operated under a variety of conditions and with various modifications.

FIG. 5 illustrates the relationship between temperatures (on the x-axis) and $NO_2$ (on the y-axis) according to the data found in Tables 1 to 4 inclusive and Tables 15 and 16 for the first cylindrical embodiment and Table 14 and Table 17 for the second flat surface embodiment.

Figure 6:
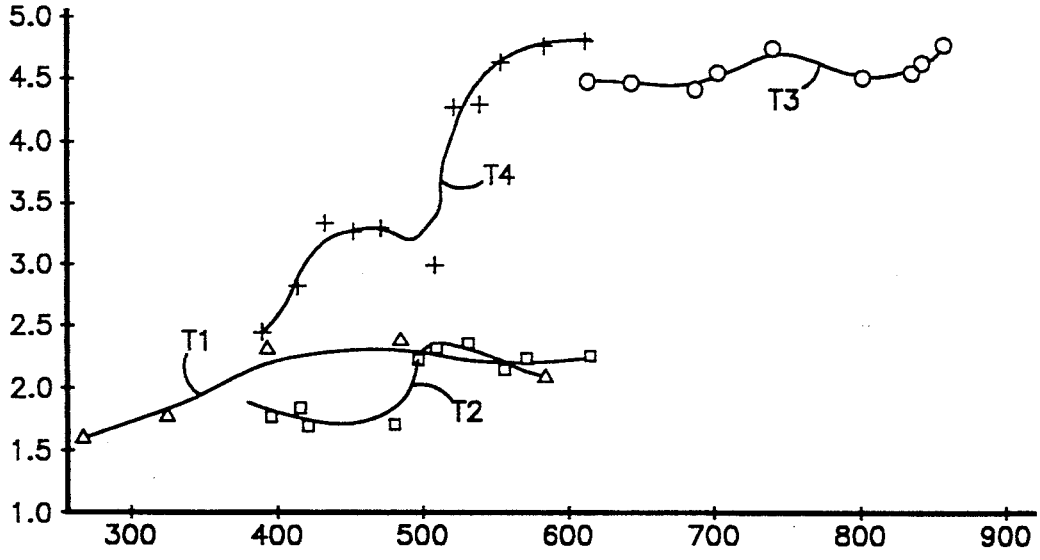
FIG. 6 is a graph showing the relationship between burner loading and nitrogen dioxide emission levels for various configurations of the first embodiment burner.

Similarly, FIG. 6 shows the relationship between burner loading (on the x-axis) and $NO_2$ (on the y-axis) for the same configurations of the burner.

It is clear from these results that irrespective of the operating conditions, the burner can be considered to show inherently low emission levels of $NO_2$. It is also clear that the best results are achieved when the burner is run at its design loading. Overloading the burner represents a step change to an increase in $NO_2$ emission levels. However, the curve T4 shows clearly that if the burner air/gas ratio is to be maintained at approximately stoichiometric, there is a clear optimum maximum burner loading for the cylindrical burner at least of about 500 $MJ/m^2hr$, above which the rate of increase in $NO_2$ emissions escalates.

Figure 7:
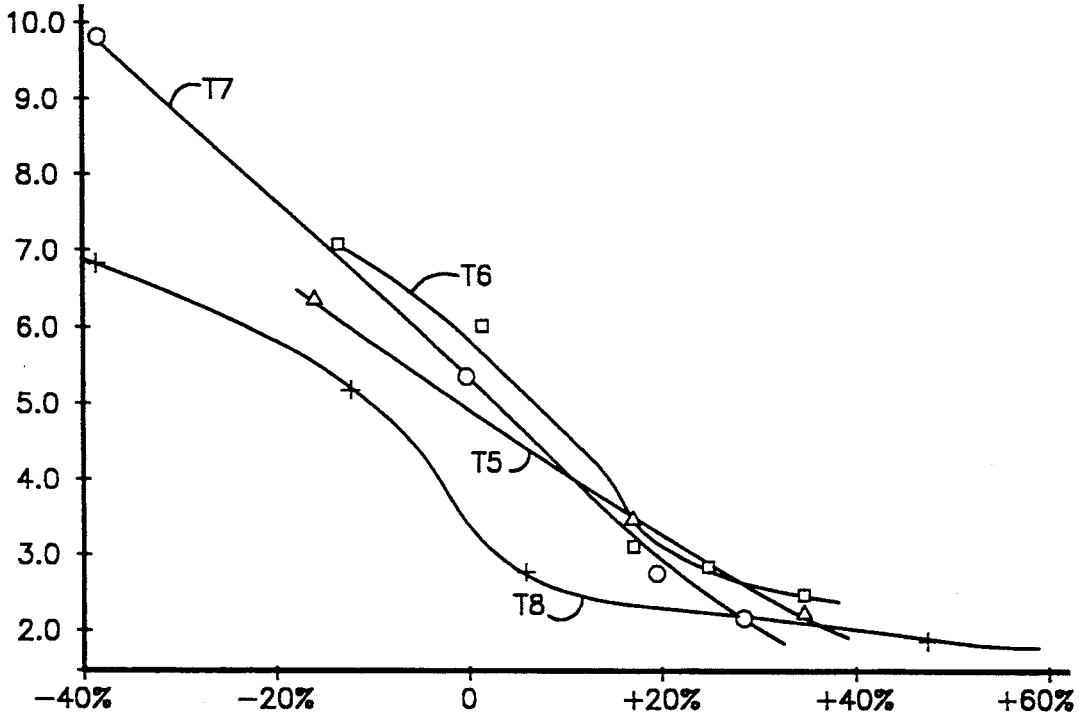
FIG. 7 is a graph showing the effect of using excess air on the emission levels of nitrogen dioxide for various configurations and operating conditions of the first embodiment burner.

FIG. 7 illustrates the effect of excess air (on the x-axis) with respect to $NO_2$ levels (on the y-axis) in accordance with the results shown in Tables 5 to 8 inclusive. Whilst it appears that additional readings may have been beneficial, it shows clearly that $NO_2$ levels decrease with an increase in air component such that beyond an excess of 20% the addition of yet further primary air has no appreciable effect.

In summary, the above results indicate the burner can still be operated at stoichiometric with what is considered to be still low $NO_2$ emission levels. Furthermore, the excess air enables the burner to run in an ultra-low $NO_X$ condition, where the air is providing an additional coolant to the combustion reaction. The burner, as previously mentioned, can also run in an overloaded condition such that the flame extends beyond the combustion surface. In this condition, the nitrogen dioxide level is still very desirable in comparison to standard blue flame burners where the $NO_2$ levels are normally in the order of 15–20 ng/Joule.

Figure 8:
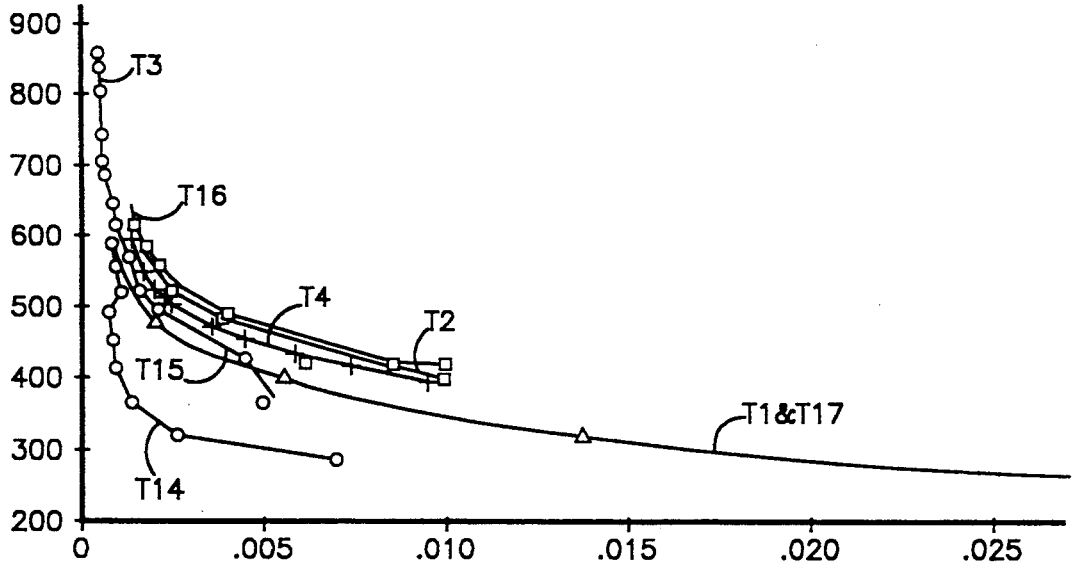
FIG. 8 is a graph illustrating the relationship between the $CO/CO_2$ ratio and burner loading for all the configurations tested.

FIG. 8 has been configured to provide a means of determining a relationship between the combustion efficiency of the burner and the port loading required to achieve those combustion levels.

Due to differing $CO/CO_2$ level requirements, depending upon local regulations and venting necessities, the burner can be operated over a broad spectrum. This graph provides a facility to determine the minimum port loading (thus lower $NO_X$) for the corresponding combustion level requirement.

Figure 9:
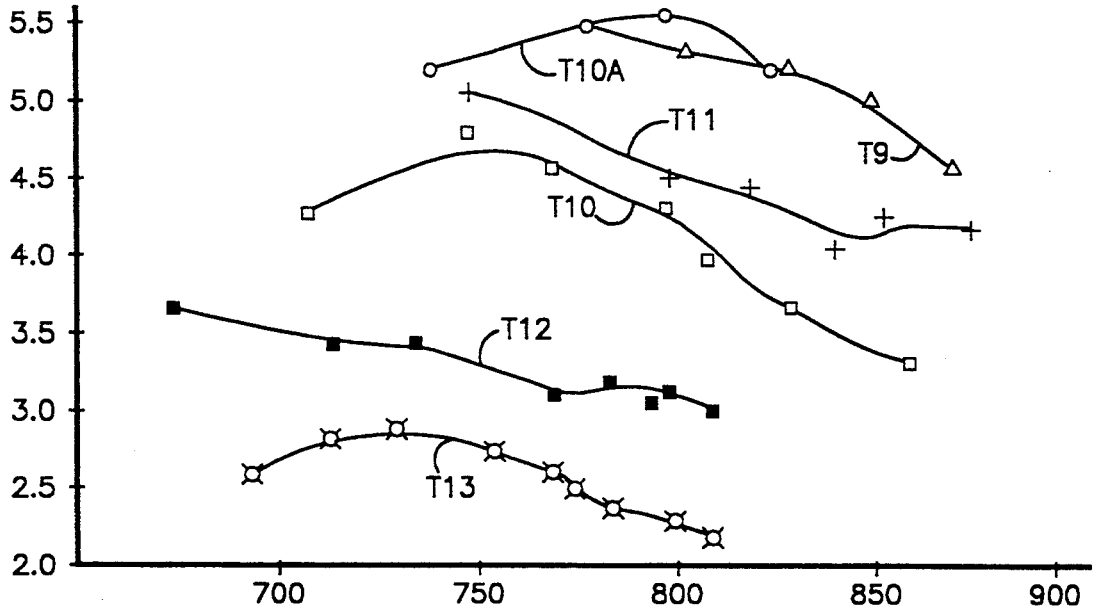
FIG. 9 is a graph of temperature against nitrogen dioxide emission levels for various configurations of the first embodiment burner.

FIG. 9 shows the results of some preliminary investigations to determine whether different burner combustion surfaces would pertain to a variation in $NO_X$ products. Burners were assembled using stainless steel mesh; four layers of inconel; and five layers of inconel mesh.

The stainless steel mesh gave comparable results to the standard three layers of inconel. The four and five layer systems gave a contradiction in results and produced levels if nitrogen dioxide in excess of what was anticipated. An increased number of layers was expected to produce an increase in time for the combustion reaction to take place; therefore, the burner could run at cooler temperatures and still maintain efficient combustion, the cooler running temperature was expected to give lower $NO_X$.

The four layer system produced higher $NO_X$ than the three layer. The five layer burner, however, gave lower $NO_X$ results than the four.

By pooling the results depicted in FIGS. 5 to 9 discussed above, it was possible to generate a further set of graphs indicating the general relationships between the important variables for production of a low $NO_X$ burner. Accordingly, FIGS. 11 to 14 inclusive can be used to determine burner loading, combustion $CO/CO_2$ ratio, excess air required and the $NO_2$ level achieved. These graphs were not updated due to time constraints to show the results obtained on the second embodiment flat burner which reduced the emission levels obtained by a further 25% on average.

Whilst the tests were limited to use of mesh of a specific size and weave, it is understood that by varying the conductivity and porosity of the combustion surface, a variation in port loading would be required to achieve the same operating temperature. Similarly, materials other than consecutive layers of mesh, such as for example a sintered metal material having similar pressure drop, porosity and conductivity characteristics, would probably achieve the same results.

Figure 10:
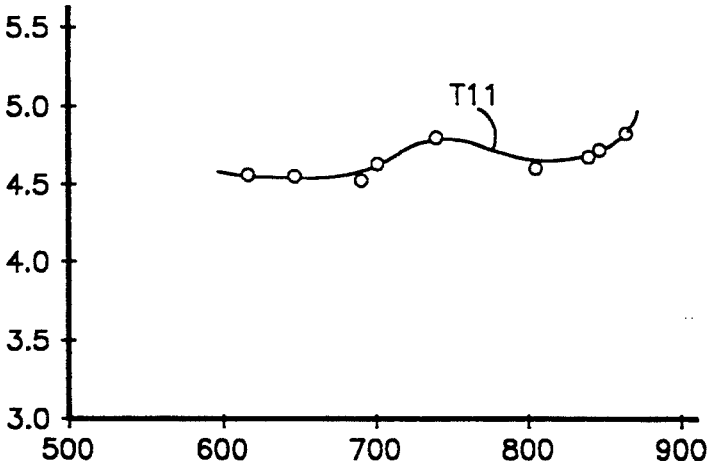
FIG. 10 is a graph showing the burner loading against nitrogen dioxide emission levels for the first embodiment burner operated in an overloaded condition.
Figure 11:
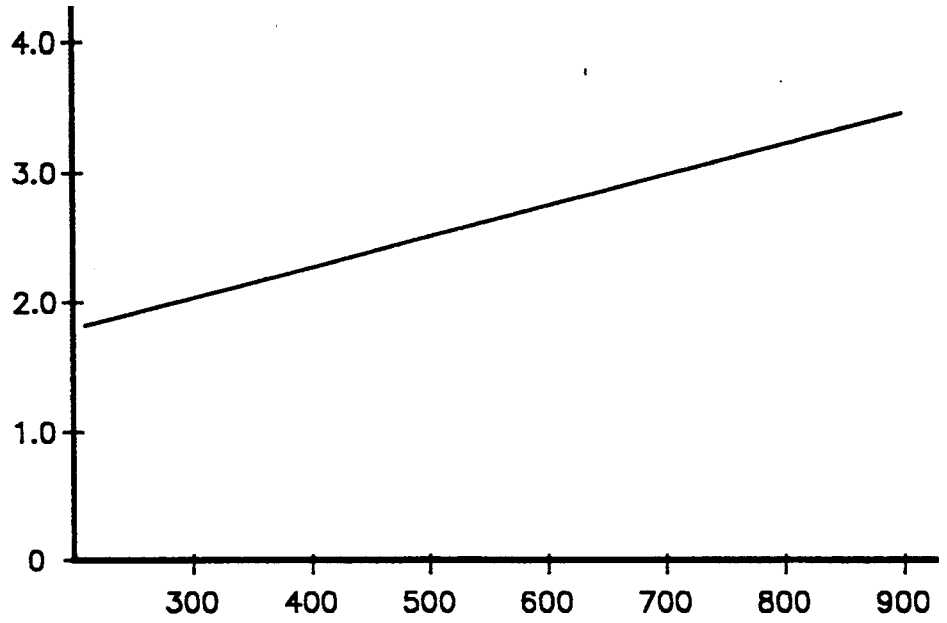
FIG. 11 is a graph depicting the averaged general relationship between burner loading and nitrogen dioxide emission levels obtained by pooling the data from the tests conducted.
Figure 12:
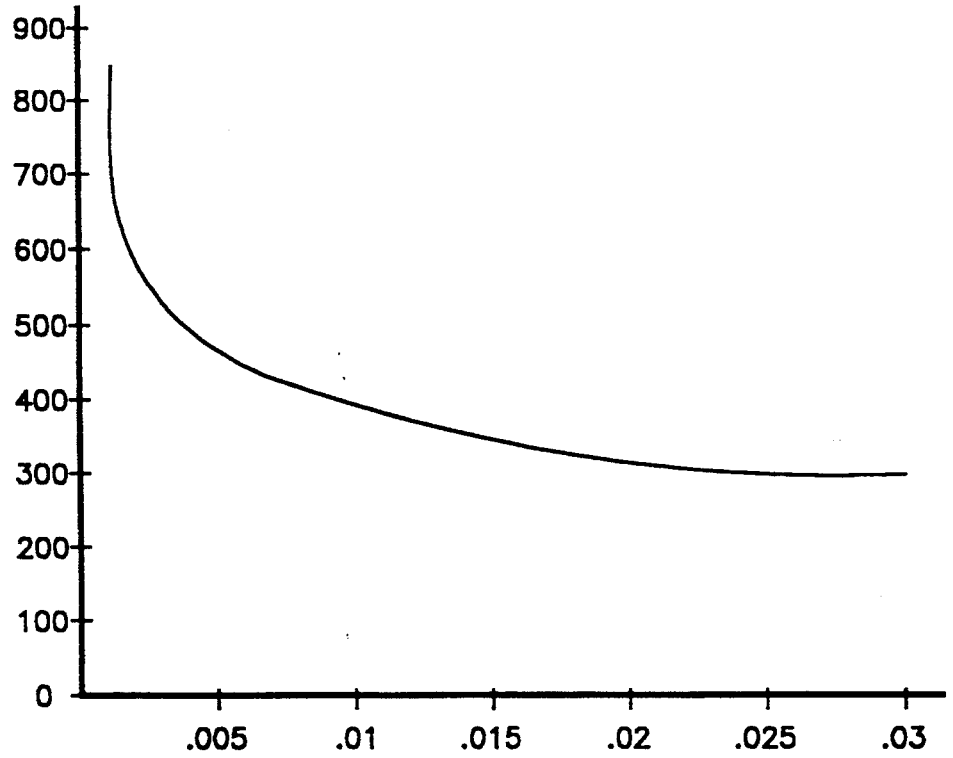
FIG. 12 is a graph showing the averaged general relationship between $CO/CO_2$ ratio and burner loading.
Figure 13:
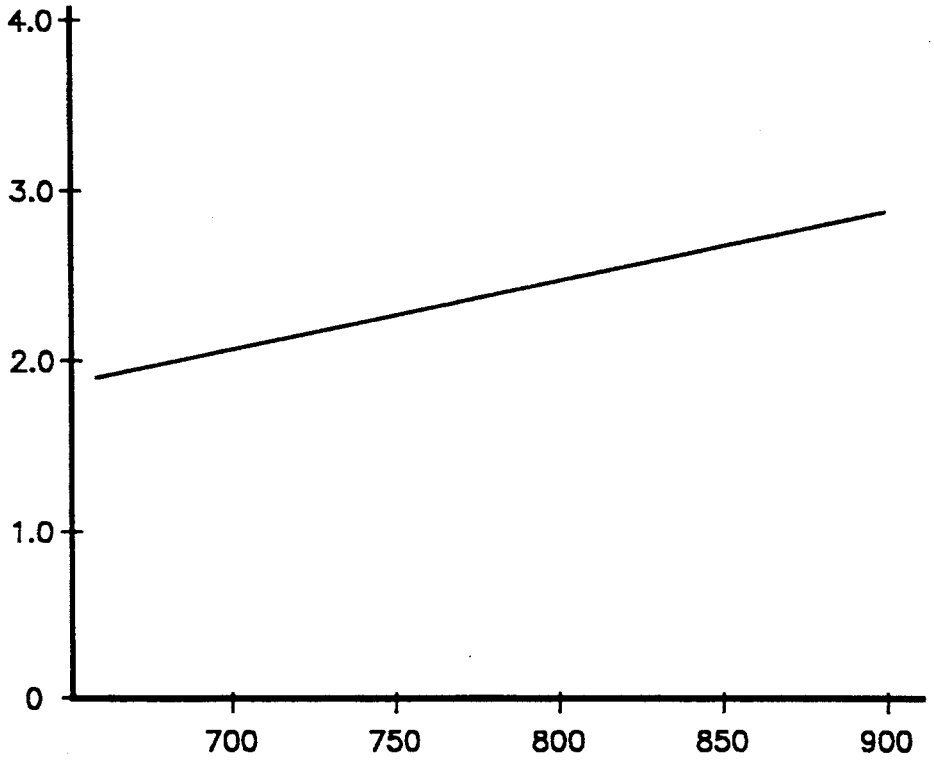
FIG. 13 is a graph showing the averaged general relationship between temperature and nitrogen dioxide.
Figure 14:
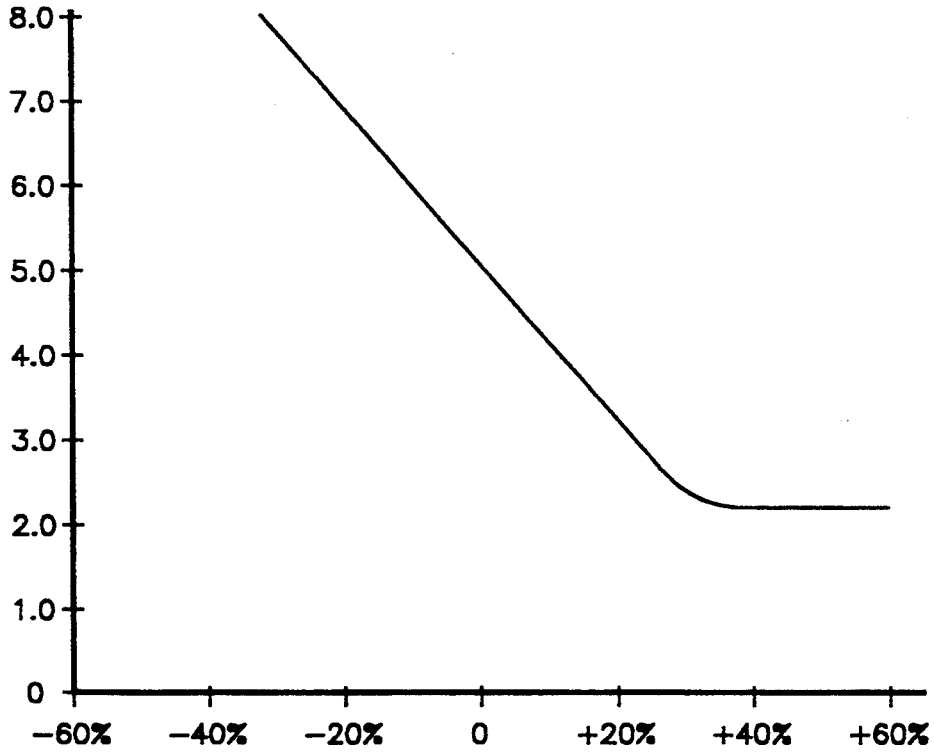
FIG. 14 is a graph showing the averaged general relationship between the percentage air in fuel/air mixture and the emission levels of nitrogen dioxide.

It also has to be recognized that in cases where the low-$NO_X$ burner was overloaded, the flame lifts from the mesh surface to a height of up to 6"–8", depending on input. The most surprising development was that, in such conditions, the nitrogen dioxide emission was still in the order of less than 5 ng/Joule, as shown in FIG. 10. This obviously has advantages in ornamental log fire and gas stove burner design.

Whilst the majority of the tests centered on the first embodiment being the cylindrical burner, it is now evident that the shape was not contributing to the low levels achieved. The limited data obtained on the flat burner indicates that in fact a more even combustion can be obtained enabling the burner to operate at even lower $NO_X$ levels. It appears upon analysis that the cylindrical burner is in fact a compromise as it is more compact for a given output, but that due to the curvature of the mesh it is not possible to obtain an even temperature across the combustion surface. Accordingly, it is necessary to run at slightly higher temperatures in order to maintain good, even combustion. It is, therefore, believed that further tests and development of the flat surface burner will reduce the $NO_X$ emissions even further.

It will be appreciated by those skilled in the art that the foregoing describes only two embodiments of the invention, and that as discussed, modifications could be made thereto to produce burners for other applications without departing from the scope of the invention.

Having described the invention, the following is claimed:

1. A method of operating a gas burner to provide substantially convective heat transfer, said burner including a plenum chamber having a combustion surface formed from a conductive porous heat resistant material, a fuel supply, an air/fuel mixing and delivery device utilizing natural aspiration for combining a flow of fuel with an air component flow to form an air/fuel mixture, comprising the steps of:

delivering said air/fuel mixture to said combustion surface at a flow providing a combustion loading of said combustion surface in the range of from about 200 to about 650 MJoules/$m^2$/hr and with an air component greater than 110% of that required for theoretical complete combustion and combusting said air/fuel mixture at a combustion temperature to form hot combustion products, selecting said air component flow in combination with said combustion loading to suppress said combustion temperature to between about 680 to about 850° C. so as to reduce the formation of oxides of nitrogen to an $NO_2$ component concentration in the range of from about 1.0 to about 5.0 ng/Joule in the combustion products, and transferring heat from said burner by substantially convective heat transfer with said combustion products.

2. A method of operating a gas burner having a rated burner input to provide substantially convective heat transfer, said burner including a plenum chamber having a combustion surface formed from a conductive porous heat resistant material, an air/fuel mixing and delivery device utilizing natural aspiration for combining a flow of fuel with an air component flow to form an air/fuel mixture for combustion at a combustion temperature to form hot products of combustion, comprising the steps of:

providing a burner having a porous surface porosity, a combustion surface area and an air/fuel mixture flow that cooperatively achieve at the rated burner input:

a) a combustion loading of from about 200 to about 650 MJoules/$m^2$hr., b) an air component greater than 110% of that required for theoretical complete combustion, and c) a combustion temperature in the range of from about 680° to about 850° C., delivering said air/fuel mixture to said combustion surface with natural aspiration of said air component for combustion with reduced formation of oxides of nitrogen to an $NO_2$ component concentration in the range of from about 1.0 to about 5.0 ng/Joule in the combustion products, and transferring heat from said burner by substantially convective heat transfer with said combustion products.

3. A method according to claim 2, wherein said air component is from about 120% to about 160% of that required for theoretical complete combustion.

4. A method according to claim 3, wherein said combustion surface porosity is in the range of from about 20% to about 60%.

5. A method according to claim 2, wherein said porous conductive heat resistant material comprises a plurality of layers of metallic mesh.

6. A method according to claim 2, wherein the step of transferring heat comprises combining said hot combustion products with air circulated in a space to be temperature conditioned or contacting a body to be heated directly with said hot combustion products.

7. A method according to claim 1, wherein said air component is between about 120% to about 160% of that required for theoretical complete combustion.

8. A method according to claim 1, wherein said air component is aspirated by flowing fuel through a venturi.

9. A method according to claim 1, wherein said conductive porous heat resistant material has a porosity between from about 20% to about 60%.

10. A method according to claim 1, wherein said conductive porous heat resistant material has a porosity of about 32%.

11. A method according to claim 1, wherein said conductive porous heat resistant material comprises a plurality of layers of metallic mesh.

12. A method according to claim 1, wherein the step of transferring heat comprises combining said hot combustion products with air circulated in a space to be temperature conditioned or contacting a body to be heated directly with said hot combustion products.

* * * * *